US010062365B2

(12) United States Patent
Finigan

(10) Patent No.: US 10,062,365 B2
(45) Date of Patent: Aug. 28, 2018

(54) VARIABLE MODE ELECTRONIC WIND CHIME WITH CHANGEABLE COLOR LIGHTS

(71) Applicant: Terrance Finigan, Arcata, CA (US)

(72) Inventor: Terrance Finigan, Arcata, CA (US)

( * ) Notice: Subject to any disclaimer, the term of this patent is extended or adjusted under 35 U.S.C. 154(b) by 0 days.

(21) Appl. No.: 15/840,124

(22) Filed: Dec. 13, 2017

(65) Prior Publication Data

US 2018/0174558 A1 Jun. 21, 2018

Related U.S. Application Data

(60) Provisional application No. 62/437,125, filed on Dec. 21, 2016.

(51) Int. Cl.

| | |
|---|---|
| ***G10D 13/08*** | (2006.01) |
| ***F21V 23/04*** | (2006.01) |
| ***F21V 33/00*** | (2006.01) |

(52) U.S. Cl.

CPC ..... *G10D 13/08* (2013.01); *F21V 23/0471* (2013.01); *F21V 33/0056* (2013.01)

(58) Field of Classification Search

CPC ..... G10D 13/085; F21V 33/0056; F21V 23/0471

See application file for complete search history.

(56) References Cited

U.S. PATENT DOCUMENTS

| | | | | |
|---|---|---|---|---|
| 4,854,214 | A * | 8/1989 | Lowe | G10K 1/066 362/253 |
| 4,967,633 | A | 11/1990 | Jewell | |
| 5,208,578 | A | 5/1993 | Tury et al. | |
| 5,315,909 | A | 5/1994 | Hsu | |
| 2007/0019404 | A1 | 1/2007 | Chen | |

* cited by examiner

*Primary Examiner* — Kimberly Lockett

(74) *Attorney, Agent, or Firm* — Global Intellectual Property Agency, LLC; Daniel Boudwin

(57) ABSTRACT

A variable mode electronic wind chime. The electronic wind chime provides a visual and audible indicator of the presence or absence of wind. A housing is the structural center of the electronic wind chime and contains a clapper, chimes and light sources corresponding with the chimes opposite of a hanger. The light sources can be modified by the insertion of color films into film slots. The clapper can be moved between various settings to enable audible sound, light source activation or a combination thereof.

7 Claims, 4 Drawing Sheets

VARIABLE MODE ELECTRONIC WIND CHIME WITH CHANGEABLE COLOR LIGHTS

CROSS REFERENCE TO RELATED APPLICATIONS

This application claims the benefit of U.S. Provisional Application No. 62/437,125 filed on Dec. 21, 2016. The above identified patent application is herein incorporated by reference in its entirety to provide continuity of disclosure.

BACKGROUND OF THE INVENTION

The present invention relates to a variable mode electronic wind chime with modifiable color lights. Many people enjoy the sounds of a wind chime outside of their home or business. Wind chimes can produce a calming and relaxing melody on a windy day. Because of the long existence of wind chimes, there has been a greater variance of wind chime design and function that has grown over time. Today, wind chimes are used inside and outside and may contain connected light functions or adjustable features for a user to change.

However, currently available wind chimes that include lighting features only focus on lighting connected to a circuit that becomes completed as a clapper connects with a chime. There is no currently available wind chime that gives a user the ability to freely and easily change the color of light that is displayed when a circuit is completed as a clapper connects with a chime. Additionally, there is no currently available device that gives a user the ability to change the mode of operation of a wind chime between sound and light activation. By solving this problem, wind chime enthusiasts will be able to have a wind chime which will allow them to freely change both the color of lights that are displayed when a chime is activation and the mode in which the wind chime operates.

SUMMARY OF THE INVENTION

In view of the foregoing disadvantages inherent in the known types of electronic wind chimes now present in the known art, the present invention provides a variable mode electronic wind chime with changeable color lights wherein the same can be utilized for providing convenience for the user by allowing them to freely change the colors of light that are displayed when a chime is activated and the mode of operation of the electronic wind chime.

The present system comprises a housing having an upper portion opposite of a lower portion. There is a hanger attached to the upper portion of the housing that extends upward. A power supply is located inside of the housing. A plurality of chimes is connected by a plurality of chime support cords to the lower portion of the housing. There is a clapper connected by a clapper support cord to the lower portion of the housing that is centrally located relative to the plurality of chimes. A plurality of light sources is on the lower portion of the housing, wherein each chime of the plurality of chimes has a corresponding light source. The light sources are located on the lower portion, adjacent to each of the chime support cords. Each light source has a film slot on the lower portion of the housing configured to allow a colored film to be inserted over the outside of the light source. A contact sensing circuit is embedded in the electronic wind chime, wherein the circuit senses contact between the clapper and each of the plurality of chimes.

Upon sensing the contact, a light source corresponding to the struck chime will be activated.

In another embodiment, the clapper is comprised of a conductive clapper configured to produce sound and light when in contact with a chime and a non-conductive clapper configured to produce sound alone when in contact with a chime. The clapper is movable between three positions that correspond to three different modes of operation. When either the conductive clapper or the non-conductive clapper makes contact with a chime, the contact sensing circuit is completed that will activate the light source corresponding to a specific chime.

When the clapper is in the first position, the non-conductive clapper will make contact with chimes and will produce sound alone when a chime is struck. When the clapper is in the second position, the conductive clapper will make contact with the chimes and will produce both sound and light when a chime is struck. When the clapper is in the third position, a conductive portion of the clapper support cord will make contact with the plurality of chimes and will produce light alone when a chime is struck.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
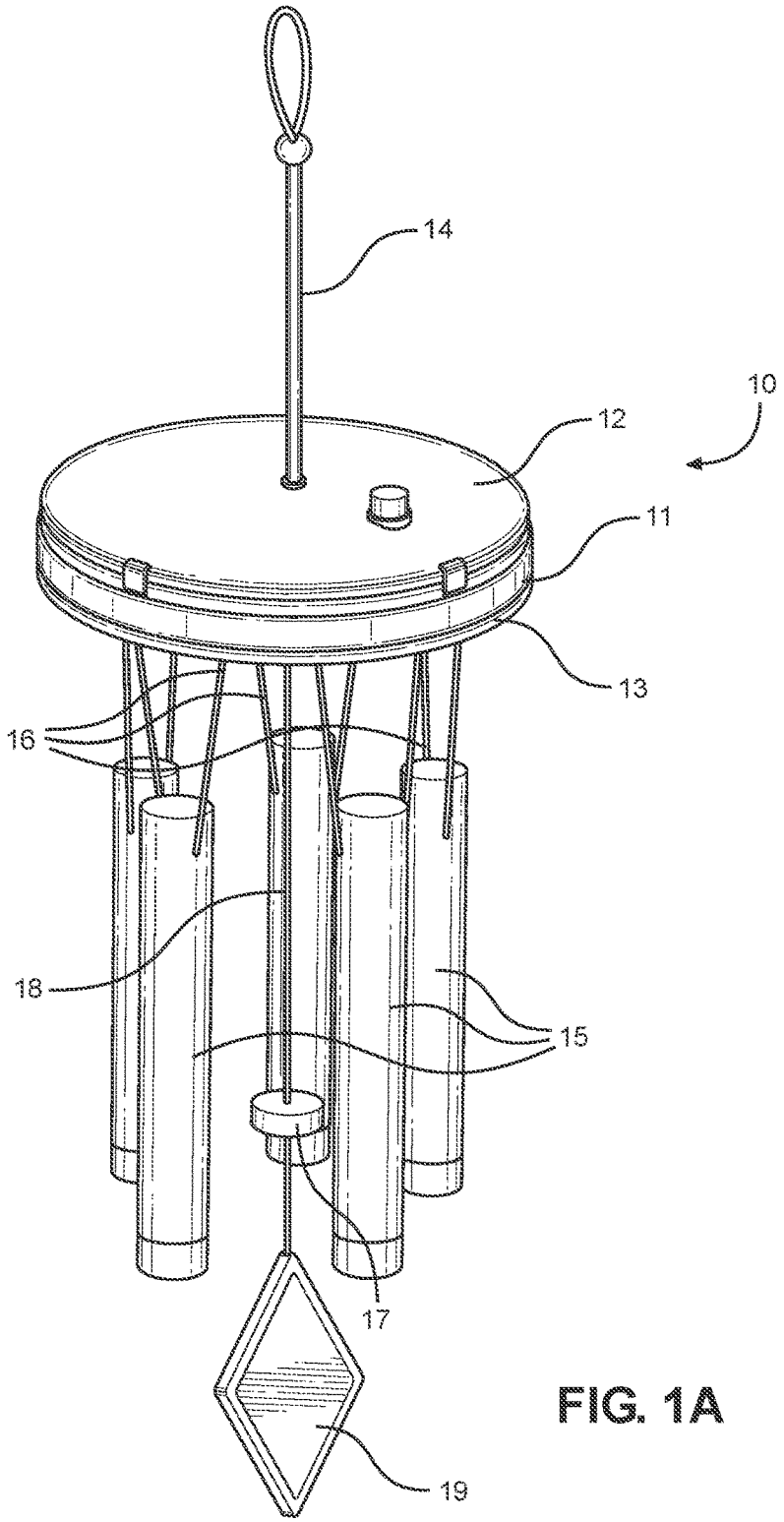
FIG. 1A shows a top-down perspective view of the electronic wind chime.

Reference is made herein to the attached drawings. Like reference numerals are used throughout the drawings to depict like or similar elements of the electronic wind chime. The figures are intended for representative purposes only and should not be considered to be limiting in any respect.

Figure 1B:
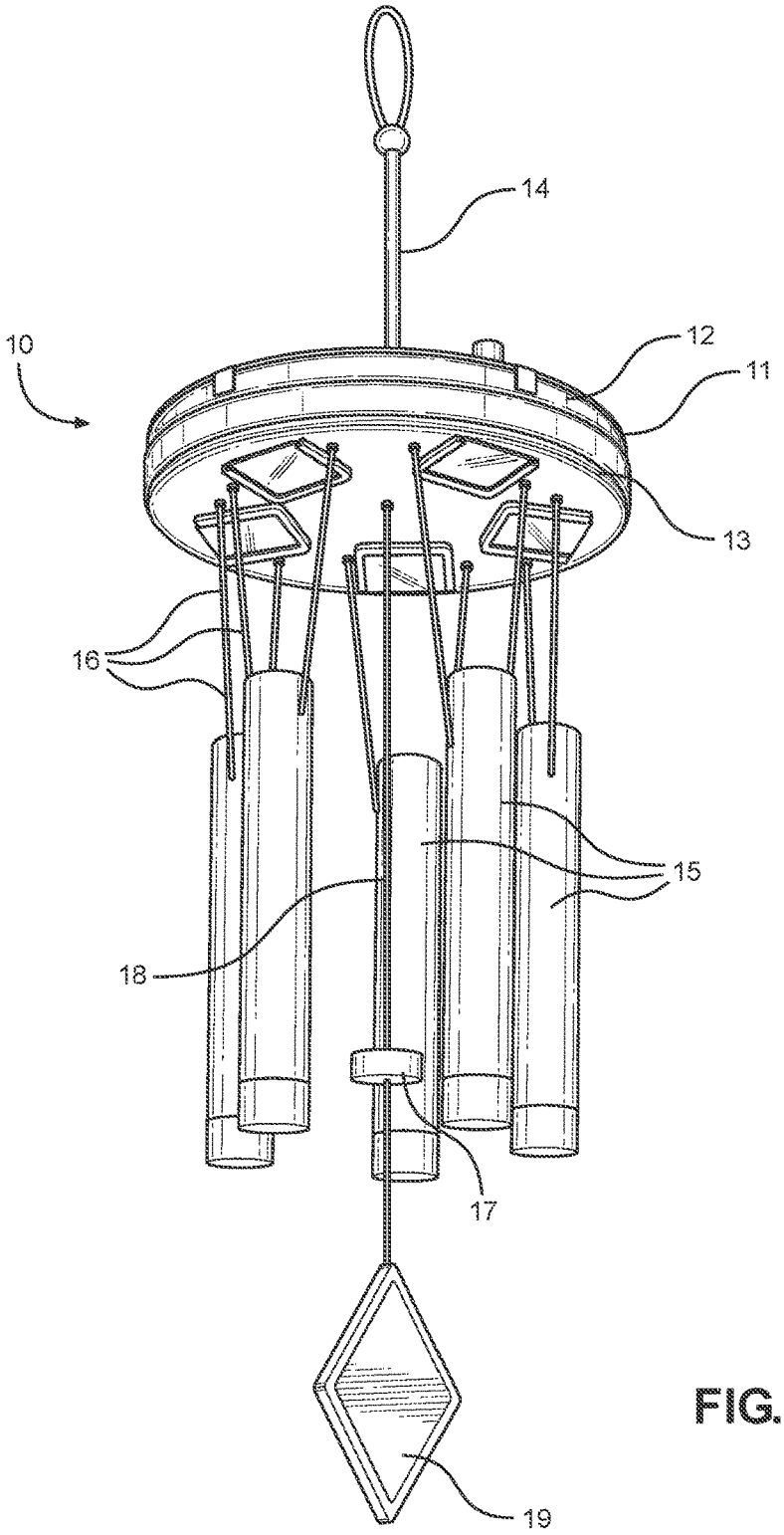
FIG. 1B shows a bottom-up perspective view of the electronic wind chime.

Referring now to FIGS. 1A and 1B, there is shown a perspective view of the electronic wind chime according to the present invention from a top-down perspective and a bottom-up perspective. The electronic wind chime 10 includes a housing 11 that defines an upper portion 12 and a lower portion 13. The housing 11 provides a structure by which the other elements are attached.

The electronic wind chime 10 has a hanger 14 extending upward, as seen in FIG. 1A, from the upper portion 12. In the shown embodiment, the hanger 14 is a cord configured to provide a loop configured to receive a support member therein and suspend the electronic wind chime therefrom. In another embodiment, the hanger 14 is a hook that interacts with a rod or other structural device. The hanger 14 is any suitable structure for hanging the electronic wind chime 10 in a way that would allow free hanging and movement of the elements.

Each chime of the plurality of chimes 15 is secured to the lower portion 13 by at least one chime support cord of a plurality of chime support cords 16. In one embodiment, the plurality of chimes 15 are secured to the lower portion 13 in a circular arrangement. Each of the chimes 15 is configured to produce an audible noise when struck. In one embodiment, the chimes 15 are hollow. Each of the chimes 15 is made from a material configured to produce audible sound when struck. The chime support cords 16 are any cords configured to support a chime 15 and adapted to allow each of the chimes 15 to be struck. In one embodiment, the chime support cords 16 are metal cords configured to attach each of the plurality of chimes 15 to the lower portion 13 by a single connection point on a proximate end of each of the plurality of chimes 15.

A clapper 17 is secured to the lower portion 13 by a clapper support cord 18. The clapper 17 is centrally located relative to the plurality of chimes 15. The clapper 17 is configured to strike the plurality of chimes 15. In one embodiment, the clapper 17 is connected to a wind catch 19. Under this embodiment, when the wind catch 19 is moved by a wind, the clapper will be moved because of the connection with the wind catch 19 to strike one or more of the plurality of chimes 15. The clapper 17 is made of a material adapted to strike a chime 15 and produce audible sound. The clapper support cord 18 is a cord adapted to support a clapper 17 in a manner that permits the clapper 17 to strike the plurality of chimes 15. In one embodiment, the clapper support cord 18 is connected to a central point of the lower portion 13 relative to the plurality of chimes 15.

Figure 2:
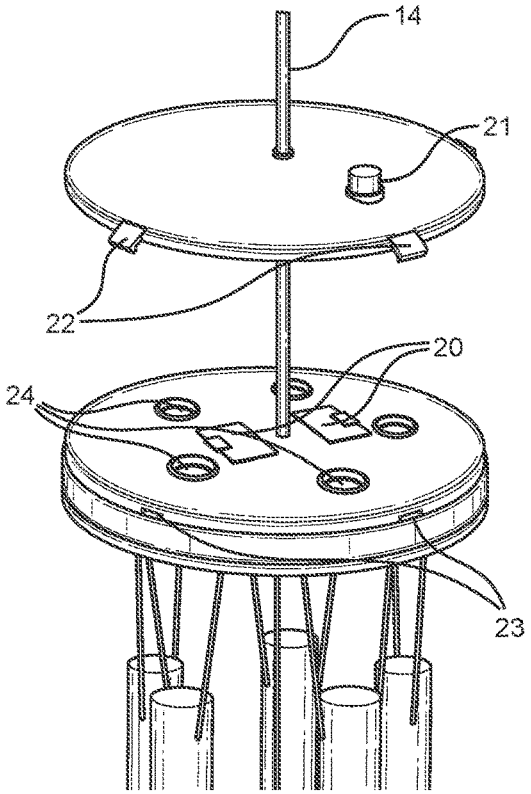
FIG. 2 shows an exploded view of the housing of an electronic wind chime according to the present invention.

Referring now to FIG. 2, there is shown an exploded view of the housing of an electronic wind chime according to the present invention. The electronic wind chime has a power supply 20. The power supply 20 provides power to the electrical components of the electronic wind chime 10. In one embodiment, the power supply 20 is a battery pack that is disposed internally in the housing. In another embodiment, the electronic wind chime is powered by solar power. In a further embodiment, the power supply is controlled by a button 21 configured to be pressed to activate and deactivate the power supply 20.

In one embodiment, the upper portion 12 is removeable from the lower portion 13. In another embodiment, the upper portion 12 is removably secured to the lower portion 13 by a plurality of clasps 22 that interact with a plurality of corresponding apertures 23. When the clasps 22 are engaged with the apertures 23, the upper portion 12 is secured to the lower portion 13. When the clasps are removed from the apertures 23, the upper portion 12 can be freely removed from the lower portion 13 to expose the internal elements of the housing 11. In another embodiment, the upper portion 12 is affixed by a hinge to the lower portion 13 with a lock opposite of the hinge.

Figure 3:
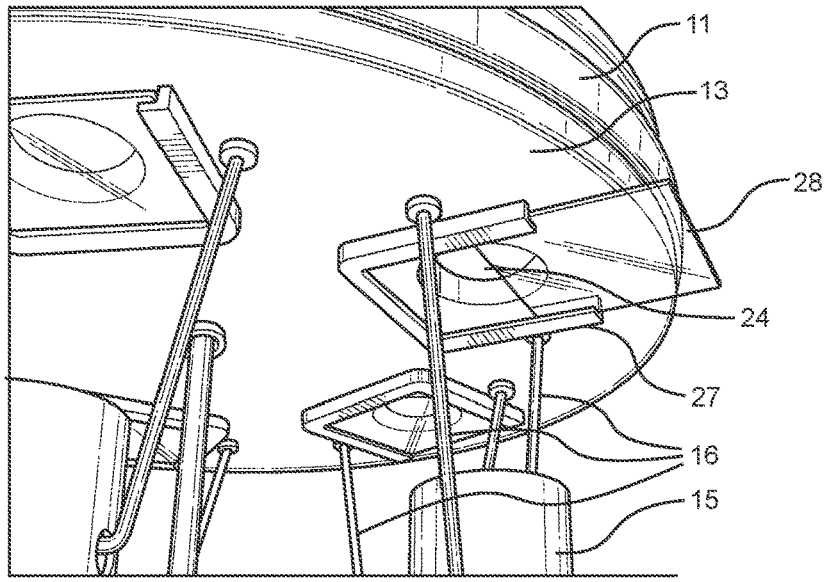
FIG. 3 shows a close-up view of the film slot portion of an electronic wind chime according to the present invention.

The electronic wind chime 10 further comprises a plurality of light sources 24 that are disposed above each of the plurality of chimes 15. In one embodiment, the light sources 24 are light bulbs housed within a plurality of cavities of the lower portion 13 corresponding to each of the chime support cords 16. Under a further embodiment, the light bulbs may be of a variety of colors. As shown in FIG. 3, the light sources are configured to be modified by the insertion of one of a plurality of color films 28 into a plurality of film slots 27. The color films 28 are transparent and are of any color.

The electronic wind chime 10 is embedded with a contact sensing circuit. The contact sensing circuit, when completed, will activate the light source 24, causing the light source 24 to illuminate a chime 15 that is in contact with the clapper 17. The clapper support cord 18 is electrically connected to a positive side of the power supply 20. The clapper 17 is electrically connected to the clapper support cord 18, assuming a positive potential charge. When the clapper 17 is brought into contact with one of the plurality of chimes 15, a momentary current path is created and the light source 24 is illuminated.

Figures 4A, 4B, 4C, 4D:
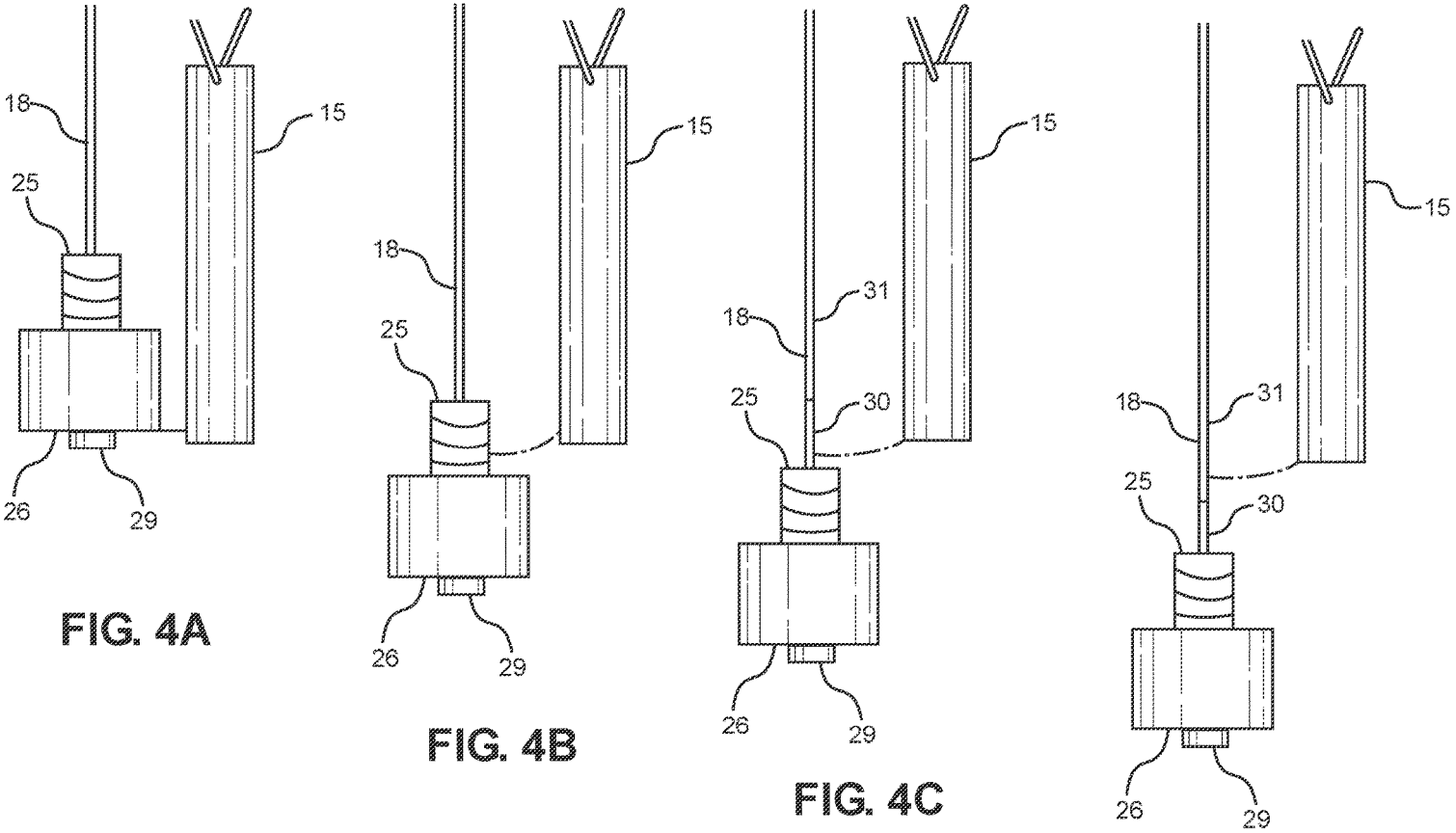
FIG. 4A shows a perspective view of the clapper of the electronic wind chime in the first position.
FIG. 4B shows a perspective view of the clapper of the electronic wind chime in the second position.
FIG. 4C shows a perspective view of the clapper of the electronic wind chime in the third position.
FIG. 4D shows a perspective view of the clapper of the electronic wind chime in the fourth position.

Referring now to FIGS. 4A-4B, there is shown a perspective view of the clapper of the electronic wind chime in the first and second position, respectively, In the shown embodiments, the clapper is comprised of both a conductive clapper 25 and a non-conductive clapper 26 on an end of the clapper support cord 18 opposite of the lower portion 13. The conductive clapper 25 contains an electronic connection to the power supply 20 and is configured to activate the contact sensing circuit upon contact with one of the plurality of chimes 15, resulting in the illumination of a light source 24. The non-conductive clapper 26 does not contain the electronic connection to the power supply 20 and is configured only to produce sound upon contact with one of the plurality of chimes 15.

In the shown embodiment, the electronic wind chime 10 further comprises an adjustable fastener 29 configured to adjust a length by which the conductive clapper 25 and non-conductive clapper 26 hang. This adjustable fastener 29 will enable a user to change the function of the electronic wind chime 10 between different modes of operation. As shown in FIG. 4A, when the length is adjusted to a first position wherein the non-conductive clapper 26 will make a contact with the plurality of chimes 15, the contact will produce only audible noise. Additionally, as shown in FIG. 4B, when the length is adjusted to a second position wherein the conductive clapper 25 will make a contact with the plurality of chimes 15, the contact will produce audible noise as well as light source activation.

Referring now to FIG. 4C, there is shown a perspective view of the clapper of the electronic wind chime in the third position. In the shown embodiment, the clapper support cord 18 comprises a conductive portion 30 and a non-conductive portion 31. As shown in FIG. 4C, the length by which the clapper 17 hangs or by which the conductive clapper 25 and non-conductive clapper 26 hang can be adjusted to a third position wherein a conductive portion 30 of the clapper support cord 18 will make contact with the plurality of chimes 15. This contact will produce only light source activation.

Furthermore, as shown in FIG. 4D, there is shown a perspective view of the clapper of the electronic wind chime in the fourth position. In the shown embodiment, when the length is adjusted to a fourth position wherein a non-conductive portion 31 of the clapper support cord 18 will make contact with the plurality of chimes 15. This contact will produce neither audible sound nor light source activation. In yet another embodiment, a mode of operation resulting in no audible sound or light source activation can be achieved wherein the length is set to the third position with the power supply 20 is deactivated by the action of a button 21.

In another embodiment, the conductive clapper 25 is a first cylindrical member attached to the clapper support cord 18 distally from the lower portion 13. The first cylindrical member further comprises an exposed wire thereon. This embodiment further comprises that the non-conductive clapper is a second cylindrical member attached to the first cylindrical member opposite of the clapper support cord 18. The first cylindrical member and the second cylindrical member are made of any non-conductive material.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electronic wind chime, comprising:

a housing having an upper portion removably affixed to a lower portion;

a hanger attached to the upper portion of the housing, the hanger configured to suspend the electronic wind chime from an overhead structure;

a plurality of chimes connected by a plurality of chime support cords to the lower portion of the housing;

a clapper connected by a clapper support cord to the lower portion of the housing;

a plurality of light sources disposed on the lower portion of the housing, each light source corresponding to at least one chime of the plurality of chimes;

a contact sensing circuit configured to detect a contact between the clapper and each chime of the plurality of chimes and configured to actuate at least one light source of the plurality of light sources corresponding to the contacted chime;

wherein the clapper is comprised of a conductive clapper and a non-conductive clapper attached to the clapper support cord;

wherein the contact sensing circuit is actuated by contact between the conductive clapper with a chime;

an adjustable fastener configured to adjust a length by which the conductive clapper and the non-conductive clapper hang;

wherein the clapper is selectively movable between a first position wherein the conductive clapper will contact the plurality of chimes, and a second position wherein the non-conductive clapper will contact the plurality of chimes.

2. The electronic wind chime of claim 1, wherein the power supply is internally disposed within the housing.

3. The electronic wind chime of claim 1, wherein the clapper is placed centrally relative to the plurality of chimes.

4. The electronic wind chime of claim 1, wherein the clapper support cord has a conductive portion and a non-conduction portion and the adjustable fastener is further configured to be movable to a third position wherein the conductive portion will contact the plurality of chimes and a fourth position wherein the non-conductive portion will contact the plurality of chimes.

5. The electronic wind chime of claim 1, wherein the conductive clapper is a first cylindrical member attached to the clapper support cord distally from the lower portion having an exposed wire thereon, and the non-conductive clapper is a second cylindrical member attached to the first cylindrical member opposite of the clapper support cord.

6. The electronic wind chime of claim 1, further comprising a plurality of film slots located on the lower portion of the housing, each film slot corresponding to each light source of the plurality of light sources wherein each of the film slots are configured to receive film therein and each of the received film is configured to alter a light emitted from at least one of the light sources.

7. An electronic wind chime, comprising:

a housing having an upper portion removably affixed to a lower portion;

a hanger attached to the upper portion of the housing, the hanger configured to suspend the electronic wind chime from an overhead structure;

a plurality of chimes connected by a plurality of chime support cords to the lower portion of the housing;

a clapper connected by a clapper support cord to the lower portion of the housing;

a plurality of light sources disposed on the lower portion of the housing, each light source corresponding to at least one chime of the plurality of chimes;

a contact sensing circuit configured to detect a contact between the clapper and each chime of the plurality of chimes and configured to actuate at least one light source of the plurality of light sources corresponding to the contacted chime;

a plurality of film slots located on the lower portion of the housing, each film slot corresponding to each light source of the plurality of light sources wherein each of the film slots are configured to receive film therein and each of the received film is configured to alter a light emitted from at least one of the light sources.

* * * * *